US007891277B2

(12) United States Patent
Ouellette

(10) Patent No.: US 7,891,277 B2
(45) Date of Patent: Feb. 22, 2011

(54) CONVERTIBLE CIRCULAR SAW APPARATUS USABLE AS EITHER A MITER SAW OR A TABLE SAW

(76) Inventor: Normand Ouellette, 1315 Route 500 Quest, Casselman, Ontario (CA) K0A 1M0

( * ) Notice: Subject to any disclaimer, the term of this patent is extended or adjusted under 35 U.S.C. 154(b) by 0 days.

(21) Appl. No.: 12/749,994

(22) Filed: Mar. 30, 2010

(65) Prior Publication Data

US 2010/0212468 A1 Aug. 26, 2010

Related U.S. Application Data

(62) Division of application No. 11/856,492, filed on Sep. 17, 2007, now Pat. No. 7,752,951.

(60) Provisional application No. 60/845,220, filed on Sep. 18, 2006.

(51) Int. Cl.
*B26D 1/157* (2006.01)
*B27C 9/02* (2006.01)

(52) U.S. Cl. ..... 83/477.2; 83/471.3; 144/48.3

(58) Field of Classification Search ..... 83/477.1, 83/471, 471.2, 663, 471.3, 462, 463, 491; 125/13.01; 144/48.3
See application file for complete search history.

(56) References Cited

U.S. PATENT DOCUMENTS 403,462 A * 5/1889 Crowe ..... 83/471
1,924,672 A * 8/1933 Zachara ..... 83/468
2,851,068 A * 9/1958 Goodlet ..... 83/471.3
3,465,793 A * 9/1969 Zuk ..... 83/477.1
3,570,564 A * 3/1971 Bergler ..... 83/471.3
4,483,573 A * 11/1984 Keller ..... 312/281
4,531,441 A 7/1985 Bergler
4,549,455 A * 10/1985 Perilloux, Jr. ..... 83/477.2
4,638,700 A 1/1987 Fushiya et al.
5,189,937 A 3/1993 Garuglieri
5,437,319 A * 8/1995 Garuglieri ..... 144/286.1
5,513,548 A * 5/1996 Garuglieri ..... 83/397

(Continued)

FOREIGN PATENT DOCUMENTS

CA 2127513 1/1995

(Continued)

*Primary Examiner*—Kenneth E. Peterson
*Assistant Examiner*—Sean Michalski
(74) *Attorney, Agent, or Firm*—Andrew M. Calderon; Roberts Mlotkowski Safran & Cole, P.C.

(57) ABSTRACT

A convertible miter/table saw comprises a base frame supporting a lower, miter saw table rotatable about a vertical axis. A circular saw assembly, namely a saw blade and motor, is mounted on a rear pedestal of the table and pivotable about a horizontal axis, the miter saw table providing a turntable and having a lower saw slot for receiving the saw blade. In miter saw mode, the swivel position of the miter saw table is adjusted and the circular saw blade moved downwards into the lower saw slot. In table saw mode, an upper saw table connected to the rear of the base frame is pivoted about a horizontal axis from a raised, generally vertical position to a lowered, generally horizontal position in which a slot in the upper saw table accommodates the circular saw blade when the latter is aligned therewith.

4 Claims, 9 Drawing Sheets

U.S. PATENT DOCUMENTS

| | | | | |
|---|---|---|---|---|
| 5,570,641 | A * | 11/1996 | Garuglieri | 108/13 |
| 5,787,779 | A | 8/1998 | Garuglieri | |
| 5,797,307 | A | 8/1998 | Horton | |
| 5,842,400 | A | 12/1998 | McIntosh | |
| 5,960,691 | A | 10/1999 | Garuglieri | |
| 6,370,997 | B1 * | 4/2002 | Rugen et al. | 83/100 |
| 7,077,179 | B1 * | 7/2006 | Camiano et al. | 144/286.1 |
| 7,089,980 | B2 * | 8/2006 | Rulli | 144/286.1 |
| 7,395,745 | B2 * | 7/2008 | Gehret et al. | 83/471.3 |
| 7,481,141 | B2 * | 1/2009 | Kelly | 83/581 |
| 7,481,142 | B2 * | 1/2009 | Kelly | 83/581 |
| 2002/0033085 | A1 * | 3/2002 | Andersen et al. | 83/477.1 |
| 2005/0061399 | A1 * | 3/2005 | Rulli | 144/286.5 |
| 2006/0005681 | A1 * | 1/2006 | Lambert et al. | 83/471.3 |
| 2008/0066598 | A1 * | 3/2008 | Ouellette | 83/477.2 |

FOREIGN PATENT DOCUMENTS

| | | |
|---|---|---|
| CA | 2129883 | 2/1995 |
| CA | 2129884 | 2/1995 |
| CA | 2127512 | 4/2004 |
| EP | 0780194 | 6/1997 |

* cited by examiner

CONVERTIBLE CIRCULAR SAW APPARATUS USABLE AS EITHER A MITER SAW OR A TABLE SAW

CROSS-REFERENCE TO RELATED APPLICATIONS

The present application is a divisional application of co-pending U.S. patent application Ser. No. 11/856,492 filed on Sep. 17, 2007 which claims the benefit of U.S. Provisional Patent Application Ser. No. 60/845,220 filed Sep. 18, 2006, the contents of which are hereby incorporated by reference in its entirety.

STATEMENT REGARDING FEDERALLY SPONSORED RESEARCH OR DEVELOPMENT

Not applicable.

REFERENCE TO A "SEQUENCE LISTING"

Not applicable.

FIELD OF INVENTION

The present invention relates to convertible circular saw apparatus and, in particular, to circular saw apparatus that can be readily converted to function as either a miter saw or a table saw.

BACKGROUND

Contractors doing construction or renovation work, such as installing kitchen cabinets, usually need both a miter saw for making accurate angled cuts across workpieces, and a table saw for performing straight cuts along large workpieces. Two saws clutter up the workplace, especially if it is confined. Also, it is a nuisance to transport two saws from site to site. Furthermore, professional quality saws are quite expensive. It is therefore desirable to have a saw which can perform both functions.

The prior art contains various examples of convertible saws which may be used in a first mode as a miter saw, or sometimes as a simple chop saw for making perpendicular cuts across workpieces, and in a second mode as a table saw. An early example, U.S. Pat. No. 1,924,672, issued Aug. 29, 1933 to Zachara, shows a type of convertible saw, which, to my knowledge has not been commercially adopted. This is a complex saw which provides mitering, cutting off, squaring, dadoing of convex or concave surfaces, tenoning, grinding or ripping, all saw operations being performed with a single circular saw blade. It includes abase unit having rails along which upper parts carrying the saw can run to perform cutting off. On this base unit is mounted an upper base unit having a vertical axis swivel carrying a horizontal axis pivot about which an arm carrying the saw and motor combination is mounted; this provides the miter cutting. Above this arm and saw/motor combination is a saw table, which is pivotally mounted so that it can be lifted up to allow mitering and other operations without interference, and can be lowered to a horizontal position, when the saw is suitably aligned to protrude through a slot in the table, in which position the saw can operate as a table saw.

In the Zachara design, the saw is belt-driven by a motor which is behind the swivel axis of the saw arm, while the back guides against which workpieces are held for miter cutting are well in front of the swivel axis. With this design it would seem that the miter angles which could be cut would be rather restricted. A further disadvantage is that, because the saw is intended to be used in so many different ways, including use as what amounts to a radial arm saw, it is very complicated and would not be particularly portable. Consequently, it would be of little or no use to a contractor who wished to use a single miter/table saw to do construction or renovation work at a customer's premises.

Present day miter saw designs differ considerably from Zachara's design in that they have compact gear drives, and swivel tables of the turntable type. Convertible versions of these saws may conveniently be described as "flip-over" saws, which have a base frame which pivotally supports the combination of a circular saw assembly and saw table, this combination being capable of being flipped over through 180°. In a first orientation, the saw assembly is above the table and has a handle by which it may be pressed down towards a slot in the table to perform chop or miter cuts. In the second orientation, the saw assembly lies below the table and can be fixed in position under the table to protrude through the slot, and so is usable as a table saw. "Flip-over" saws of this kind are represented by the following U.S. patents:

U.S. Pat. No. 5,960,691, issued Oct. 5, 1999 to Garuglieri;
U.S. Pat. No. 5,787,779, issued Aug. 4, 1998 to " ";
U.S. Pat. No. 5,570,641, issued Nov. 5, 1996 to " ";
U.S. Pat. No. 5,513,548, issued May 7, 1996 to " ";
U.S. Pat. No. 5,189,937, issued Mar. 2, 1993 to it " ";
U.S. Pat. No. 4,531,441, issued Jul. 30, 1985 to Bergler;
U.S. Pat. No. 3,570,564, issued Mar. 16, 1971 to " "; and
U.S. Pat. No. 2,851,068, issued Sep. 9, 1958 to Goodlet.

The "flip-over" design has some drawbacks. Firstly, the base frame has to be fairly large to provide space which allows the table and motor-saw blade combination to flip over through 180°, so such designs tend to be somewhat cumbersome. Also, the motor-saw blade combination is heavy, so the pivot mechanism must be robust and the user may find it awkward to switch from one mode to the other.

Another problem is that some of the most desirable miter saws are not adaptable to the flip-over design, since the saw table is in the form of a turntable having the required saw slot. This turntable also has structure below the slot, used for mounting or moving the turntable, which structure would not allow the miter saw to be inverted and used as a table saw. Such miter saws include those manufactured by Makita Corporation, for example that shown in U.S. Pat. No. 4,638,700, issued Jan. 27, 1987, which is otherwise a desirable type of miter saw for professional work. The turntable structure shown in FIG. 2 of that patent would not allow the saw blade to project through the turntable, so it would be unsuitable for use in a "flip-over" convertible saw design.

SUMMARY OF THE INVENTION

An object of the present invention is to overcome or at least mitigate the disadvantages of such known convertible saws, or at least provide an alternative. In accordance with one aspect of the present invention, circular saw apparatus usable as either a miter saw or a table saw, comprises:

a base frame;

a mounting pedestal to the rear of the base frame;

a lower, miter saw table rotatably mounted on the base frame for swivelling movement about a vertical axis, the miter saw table having a lower saw slot for receiving a circular saw blade;

a circular saw assembly having a saw blade and motor combination pivotally mounted on the rear mounting pedestal for pivoting relative thereto about a horizontal axis, whereby the miter table provides a turntable for the circular saw assembly;

handle means for adjusting the swivel position of the miter saw table and for moving the circular saw about the horizontal axis so that the saw blade can move into and out of the lower saw slot;

a workpiece back guide fixedly mounted on the base frame for positioning a workpiece on the miter saw table and located behind the vertical axis of the miter saw table so that the circular saw can be used in miter saw mode, upon adjustment of the swivel position of the miter saw table, by downwards movement of the circular saw blade into the lower saw slot by manipulation of the handle means;

an upper saw table pivotally connected to a rear portion of the base frame for movement about a horizontal axis between a raised position and a lowered, generally horizontal position, the upper saw table when in the raised position being clear of the circular saw assembly when the saw assembly is being used in miter saw mode, the upper saw table having an upper saw slot which accommodates the circular saw blade when the latter is aligned therewith and when the upper saw table is in the lowered position.

This circular saw apparatus may further comprise movable posts which support the front of the upper saw table above the base frame when the upper saw table is in its lowered position, these posts being movable clear of the space between the upper saw table and the base frame when the upper saw table is raised. The posts may be pivotally attached to either the base frame or the upper saw table.

Preferably, the miter saw will have a guard which will prevent the upper part of the saw blade protruding through the upper saw table slot, and accordingly this guard will be partially or wholly removed when the saw assembly is to be used as a table saw. In the preferred embodiment, this guard includes a lower portion which protects a lower front portion of the circular saw blade at all times, and a removable upper portion adapted to be removed when the upper saw table is to be lowered over the saw blade to allow the saw blade to project through the upper saw slot.

The handle means may include a handle projecting forwardly from the miter saw table and usable to adjust and lock the swivel position of the miter saw table.

Embodiments of the invention also may be provided in the form of a conversion kit for converting a circular miter saw into a combination saw which is additionally useable as a table saw, in which the circular miter saw is of the kind having a base frame, a turntable with a saw slot mounted on the base frame for swivelling motion about a vertical axis, a pedestal at the rear of the turntable and having a saw arm mounted thereon about a horizontal pivot; a circular saw assembly including a saw blade and motor mounted on the saw arm, handle means for operating the saw arm, and a workpiece back guide fixedly mounted on the base frame, and having a guard for the blade. This is a type of miter saw much used by professionals, as manufactured for example by Makita Corporation (see, for example, the above-mentioned U.S. Pat. No. 4,638,700), and which usually has structure under the turntable which would prevent it being used in the "flip-over" manner. A suitable conversion kit for such a miter saw includes;

a) an upper saw table and pivot means for connecting the upper saw table to a rear portion of the miter saw base frame for movement about a horizontal axis between a raised and a lowered, generally horizontal position, the pivot means being such that the upper saw table, when in the raised position, is clear of the circular saw when the saw is being used in miter saw mode, the upper saw table having an upper saw slot which accommodates the circular saw blade when the latter is aligned therewith and when the upper saw table is in the lowered position, b) means for supporting the front of the upper saw table above the miter saw base frame when the upper saw table is in its lowered position, and c) means replacing the saw blade guard with a guard which is, at least in part, readily removable to allow the saw blade to project through the slot in the upper saw table.

BRIEF DESCRIPTION OF THE DRAWINGS

A preferred embodiment of the invention will now be described by way of example only with reference to the accompanying drawings, in which.

DETAILED DESCRIPTION OF THE INVENTION

Figure 1:
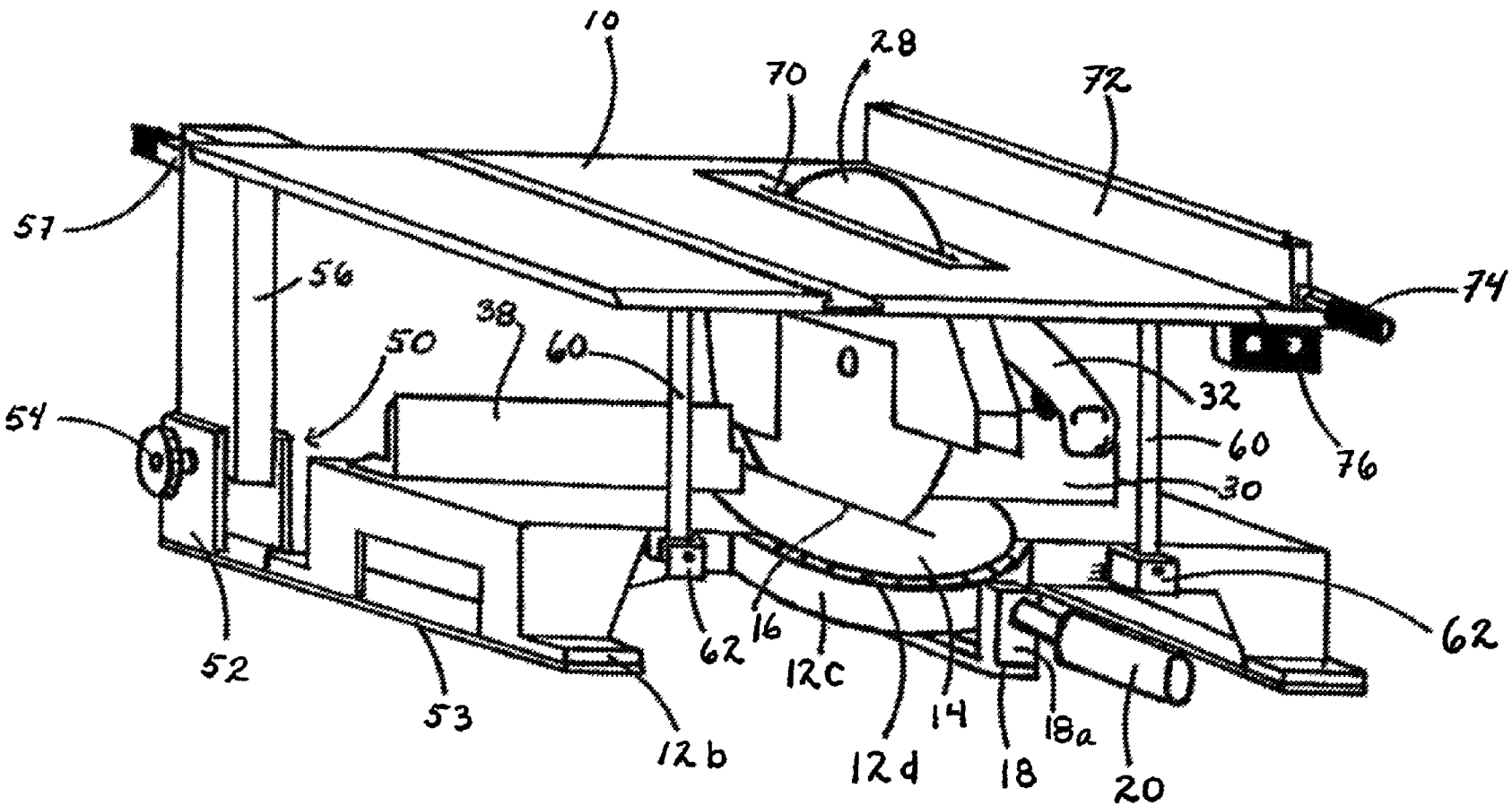
FIG. 1 is a perspective view of a convertible saw embodying this invention in the table saw mode.
Figure 2:
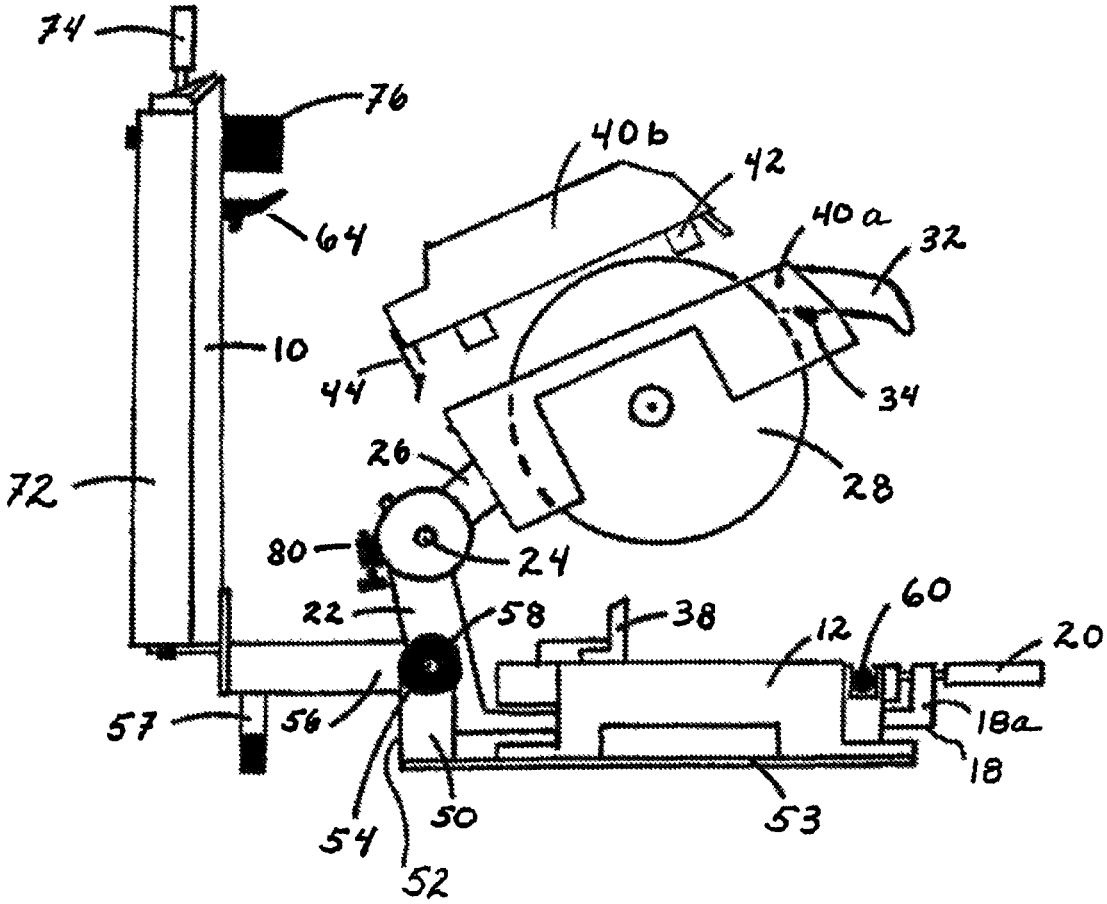
FIG. 2 is a side view of the same saw in the process of being converted to its miter saw mode.
Figure 3:
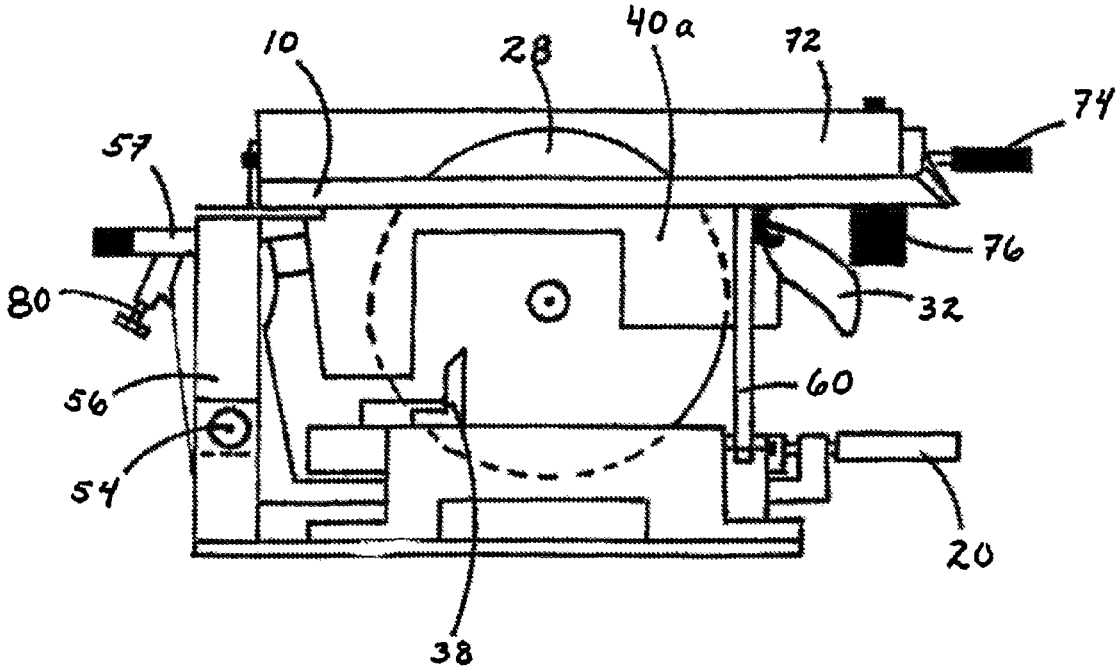
FIG. 3 shows a side view of the saw in the table saw mode.
Figure 4:
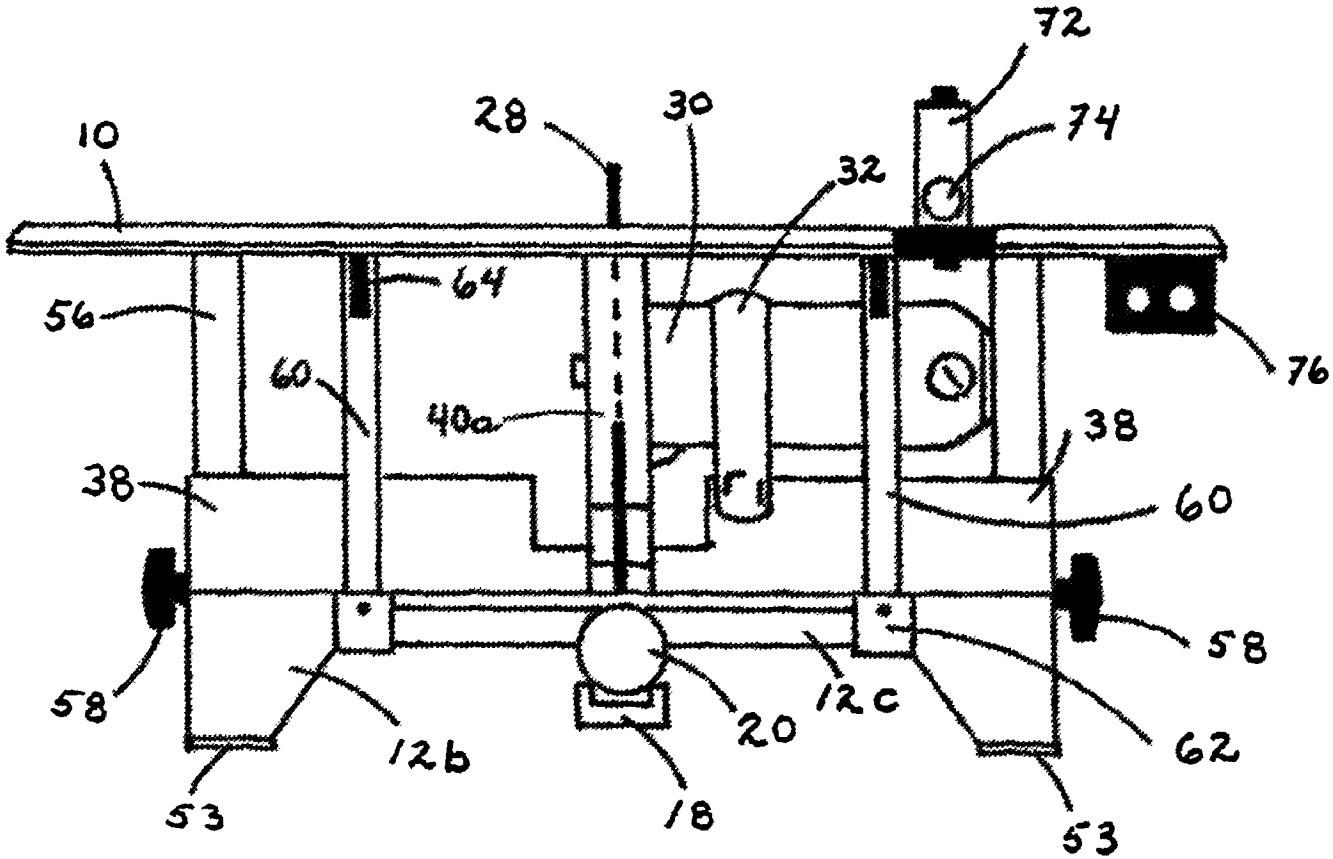
FIG. 4 shows a front view of the saw in the table saw mode.
Figure 5:
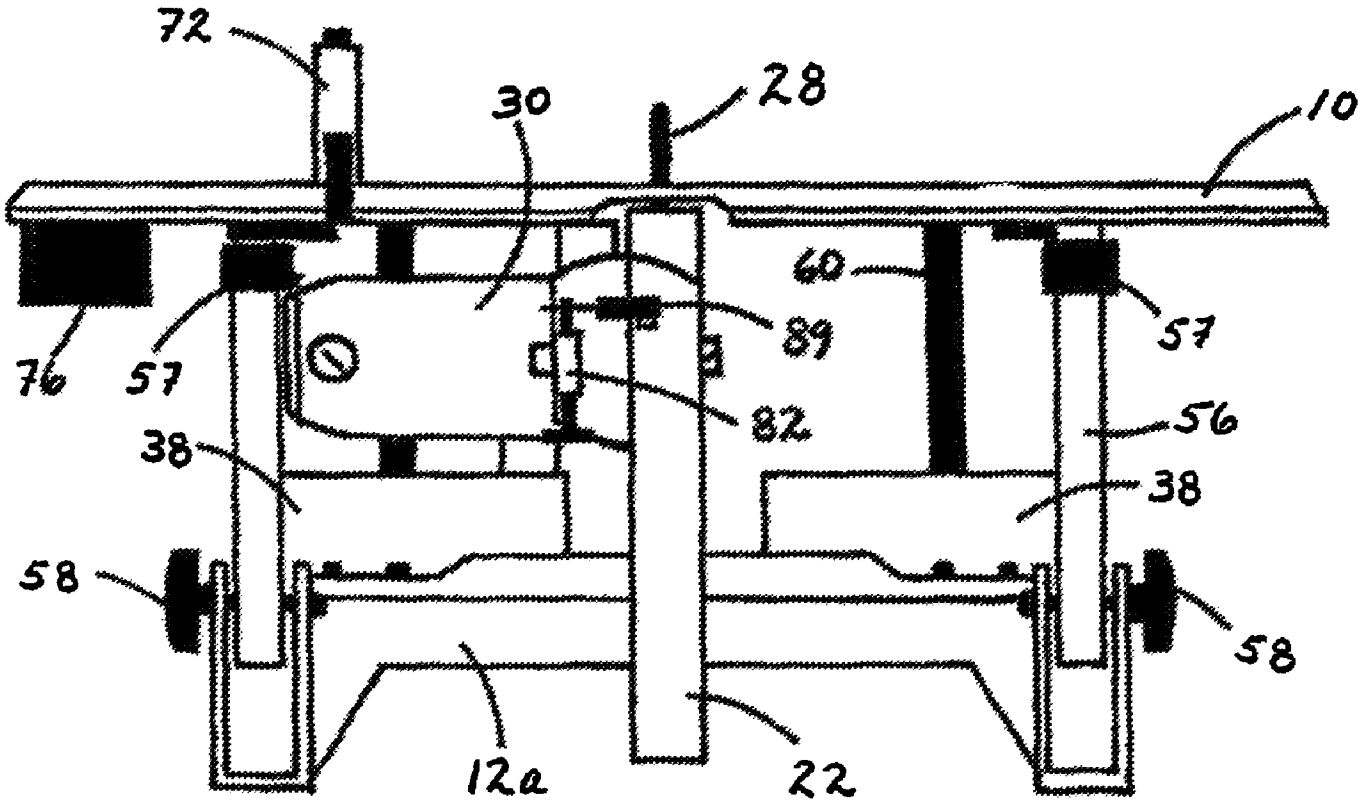
FIG. 5 shows a rear view of the saw in the table saw mode.

FIGS. 1 and 2 illustrate the general arrangement of the convertible saw in its two different modes, with the upper saw table 10 respectively in its lowered position over the miter saw components to provide the table saw, and in its raised position allowing normal usage of the miter saw.

As indicated, the basis of the convertible saw is a miter saw of the kind made by Makita Corporation, and is similar to that described in afore-mentioned U.S. Pat. No. 4,638,700. It has a base frame 12 having a raised, rectangular, planar portion 12*a* supported by four feet 12*b*. The base portion has a central enlargement including a protruding, part-circular front portion 12*c*, and this enlargement is provided with a concentric, circular, open-bottomed recess 12*d*. This recess accommodates a disc-like turntable 14 having a lower saw slot 16 extending along a part of its diameter. The rotational position of the turntable 14 can be adjusted by means of a handle bracket 18 fixed to the bottom of the turntable 14 and movable in the open bottom of recess 12*d*, this bracket extending forwards of the base frame and including a raised front lug 18*a* which has a threaded bore to receive the threaded shaft of a turntable handle 20. The rear end of this threaded shaft can be locked onto the outer side of the part-circular front portion 12*c*, to fix the angular position of the turntable, by twisting handle 20.

The rear of the turntable 14 carries a rear mounting pedestal 22, best seen in FIG. 2, and the upper end of this pedestal has a horizontal pivot 24 carrying an arm 26 which supports a circular saw assembly including a saw blade 28 and an electric drive motor 30 that drives the blade through a gear train. The arm 26 is urged upwardly by spring means (not shown), and is manipulated by a handle 32 at the front end of the arm, this handle having an on/off switch 34 (FIG. 2) on its underside for use when the saw is in the miter cutting mode.

A workpiece guide or fence 38 extends across the rear portion of the turntable 14, being fixed to outer side areas of the base frame 12, this fence having a central aperture or recess to accommodate the saw blade 28.

The items so far described are conventional for miter saws, and similar parts are shown for example in the Makita Corporation '700 patent referred to above. As is also usual for miter saws, the upper portion of blade 28 is covered by a guard 40. Here, however, the guard is modified by having a fixed lower portion 40*a* which covers a lower front part of the blade at all times, but leaves uncovered an upper part, perhaps ⅓ or ¼, of the blade 28. The upper blade part may be covered by a removable upper guard portion 40*b*, shown in FIG. 2, having guide plates 42 extending into the top cavity of the portion 40*a* and also having spring clips 44 extending from its lower sides, by which it can be removably attached to the lower portion 40*a* when the saw is used in the miter saw mode.

The other additions to the miter saw, which make it convertible for use as a table saw, will now be described.

At the rear corners of the base frame are provided pivot brackets 50, each bracket being formed by a pair of upstanding lugs 52 fixed to the rear of an elongate base plate 53 which extends forwardly under the feet 12*b* of the base frame and is attached thereto. Each pair of lugs supports a horizontal pivot 54 which mounts a back support post 56 fixed to a rear corner of the upper saw table 10. The rear sides of the support posts 56 are provided with rearwardly protruding legs 57 by which the table 10 is supported, by the contact of legs 57 with a support surface, when the upper saw table 10 is in the vertical position shown in FIG. 2. In addition, each pivot 54 has a screw threaded portion and a knurled knob 58 for locking the leg 56 relative to the bracket 50.

Figure 6:
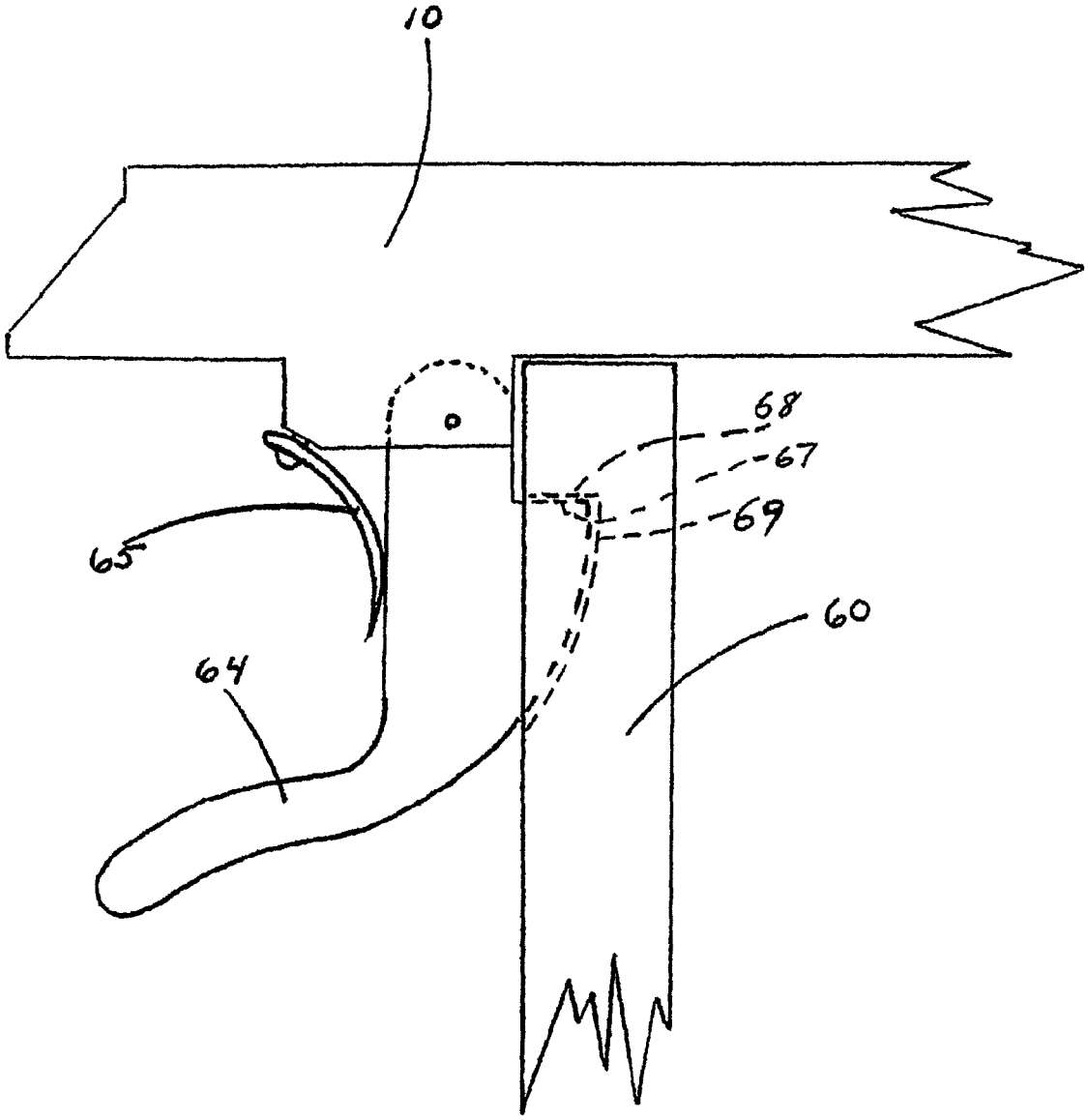
FIG. 6 shows a detail of a catch used to secure the upper saw table in the lowered position.

In its lowered, horizontal position, the front of upper saw table 10 is supported by two movable posts 60. These posts have their lower ends pivotally held by brackets 62 fixed to the front of the base frame 12 at the sides of the enlarged portion 12*c*. When the upper saw table is lowered, the posts 60 are placed vertically and are located in position by locking clips 64 (see FIG. 6) pivoted to the underside of the table 10 at the front. As shown in FIG. 6, each clip 64 is pushed by a spring plate 65 into a locking position wherein a shoulder 67 of the clip 64 engages a stop face 68 in a complementary recess 69 in leg 60. When the user wishes to lift the upper saw table 10 to the FIG. 2 position, the locking clips 64 can be disengaged from the recesses 69 and the posts 60 can be swung out sideways and laid horizontal (see FIG. 2) so as not to interfere with miter saw operations. The use of recesses 69 presumes that the legs 60 are solid, which is preferred. If the legs were tubular, of course, an alternative locking arrangement could be used, as appropriate.

The upper saw table 10 has a fore-and-aft extending upper saw slot 70 which can receive an upper part of saw blade 28 when the saw arm 26 is in a generally horizontal position and aligned with the slot 70, when the upper guard portion 40*b* has been removed, and when the table 10 is in the lowered position. The saw slot 70 then generally overlies the lower saw slot 16 of the turntable, and also overlies the swivel axis of the turntable 14. The Upper saw table 10 may have the usual accessories of a table saw, including an adjustable side guide 72 controlled by a handle 74. Also, the upper saw table 10 carries control buttons 76 which are used to control the saw motor when the saw is being used in table saw mode.

Figure 7:
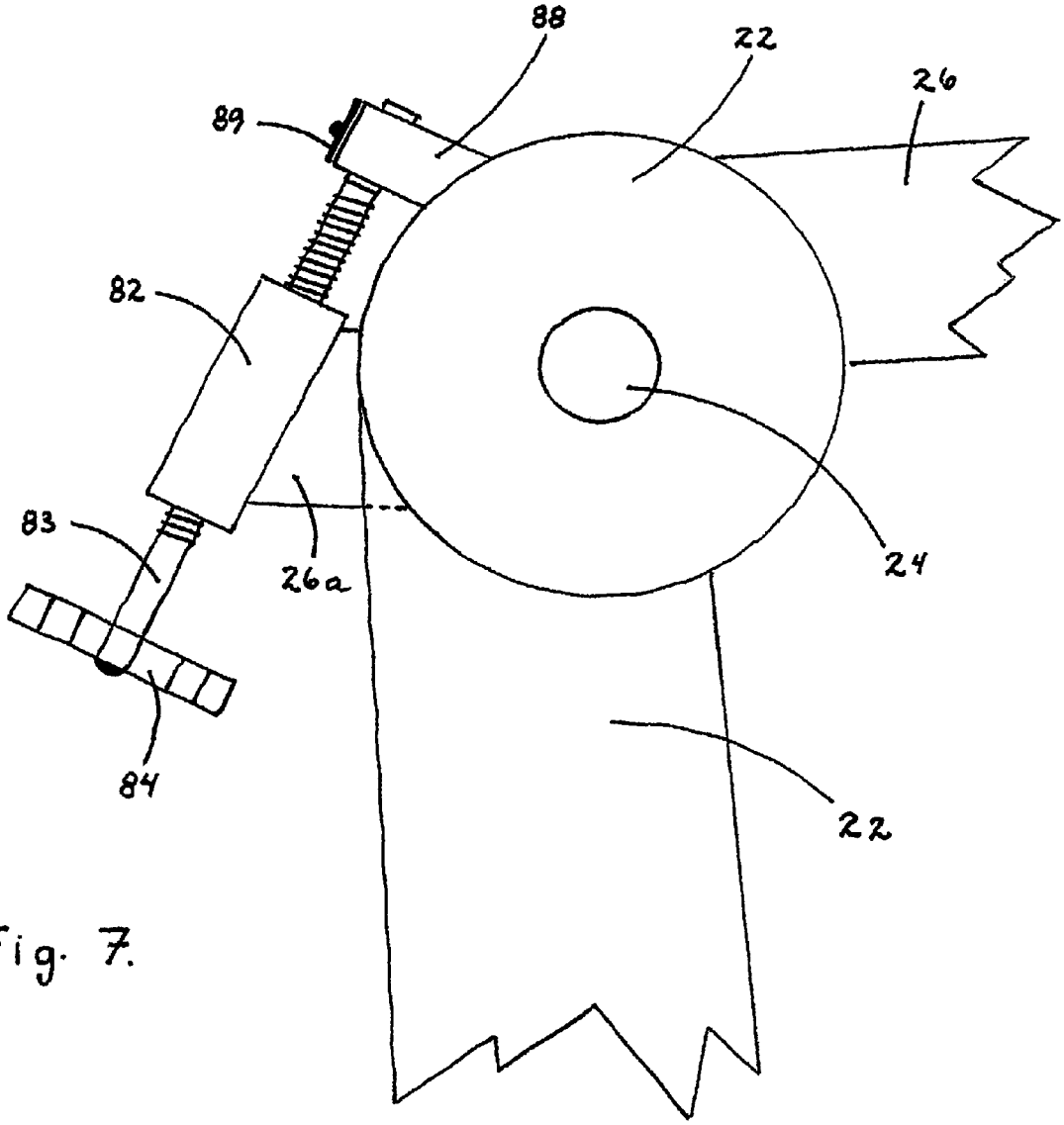
FIG. 7 shows a detail of the locking means for holding the saw assembly arm in the table saw position.
Figure 8A:
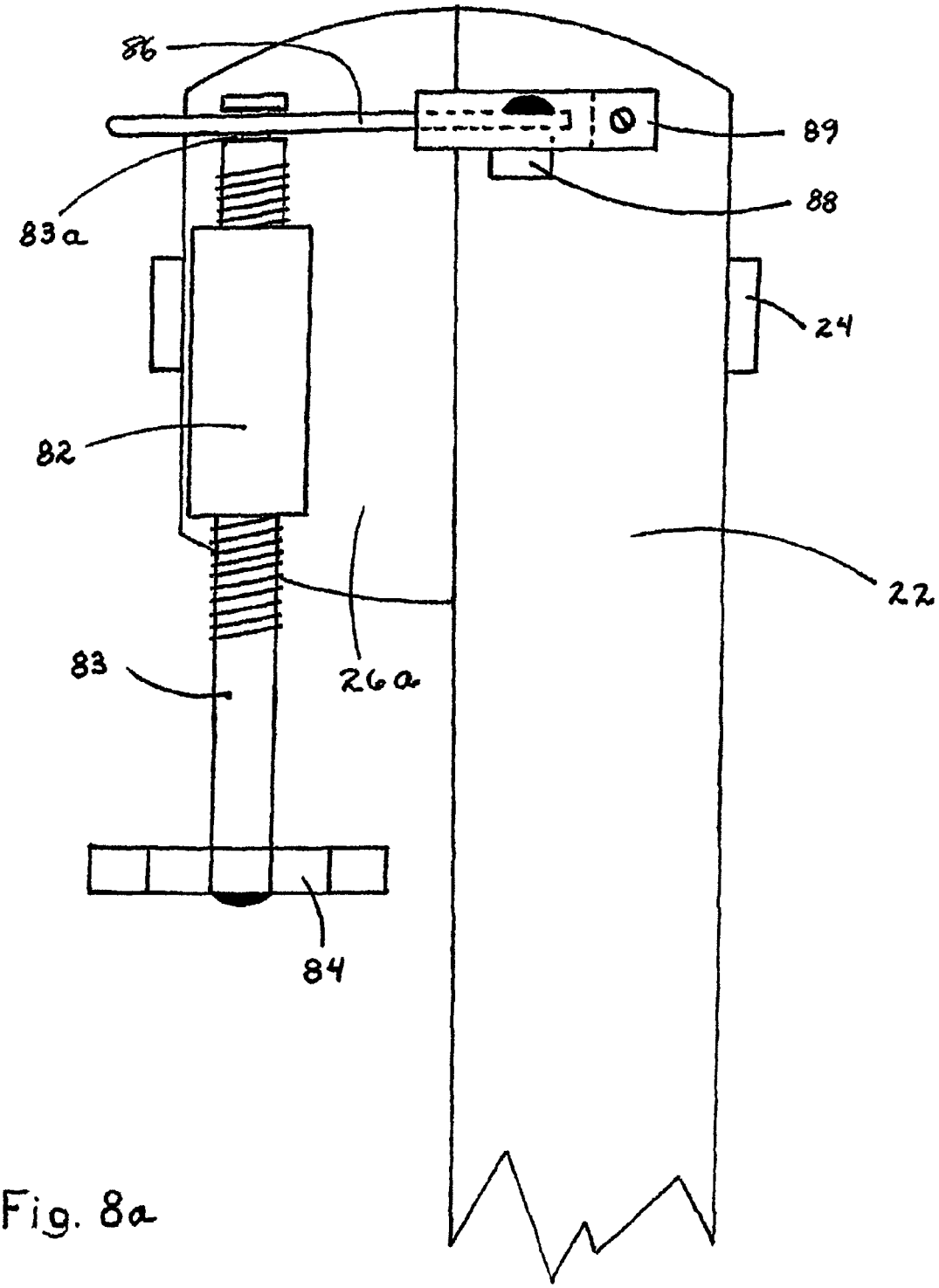
FIGS. 8*a* and 8*b* show further views of the locking means for the saw assembly arm.
Figure 8B:
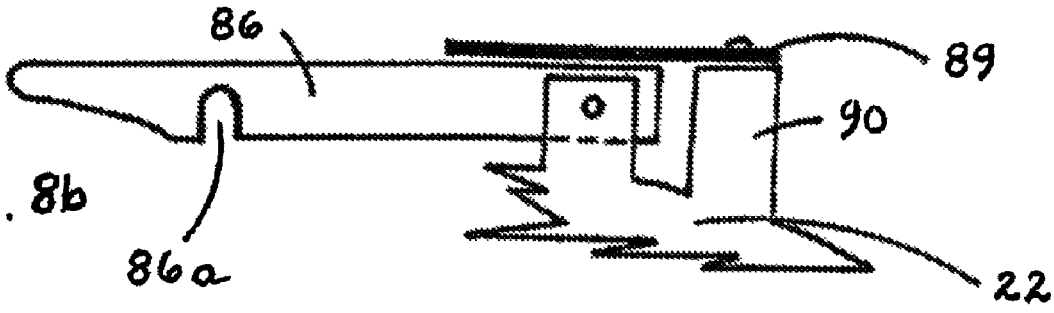

FIGS. 7, 8*a* and 8*b* show details of an adjustment mechanism 80 for fixing the position of the saw arm 26 (FIG. 2) when operating in the table saw mode; this mechanism is disengaged when operating in the miter saw mode. The mechanism includes a lug 26*a* extending from the rear end of the saw support arm 26, behind pivot 24, and this lug 26*a* carries a threaded sleeve 82 in which is mounted a threaded shaft 83 rotatable by knob 84 at one end thereof. As seen in FIG. 8*a*, the outer end of shaft 83 has a reduced diameter portion 83*a* at its opposite end which can engage in a recess 86*a* (FIG. 8*a*) in a locking plate 86 shown in FIG. 8*a*. This plate 86 is pivotally attached to a lug 88 held by an upper end portion of the pedestal 22 and urged into engagement with the shaft 83 by a leaf spring 89.

When the saw is being used as a table saw, the plate 86 engages the shaft 83 as described, and rotation of the knob 84 can adjust the height of the arm 26 and therefore of the saw blade 28; and can thus adjust its amount of protrusion through the upper table slot 70. When the saw is used as a miter saw, the user urges plate 86 against the spring 89 and disengages it from the shaft 83, allowing the saw blade and motor to be raised and lowered.

It will be understood that, in operation as a miter saw, the upper table 10 will be raised to the vertical position of FIG. 2, and held there by tightening of the knobs 58 to secure the rear pivots 54. Also, the front support posts 60 are pivoted outwards to lie horizontally, so as not to interfere with miter saw operations. The top portion 40*b* of the saw guard is put in place, and the plate 86 is pivoted to release recess 86*a* from the shaft 83. The saw can then be used as a conventional miter saw, the motor being controlled by switch 34.

For use as a table saw, upper guard portion 40*b* is removed, the turntable is adjusted by handle 20 so that the saw blade 28 is aligned with the saw slot 70 in the upper saw table 10, the plate 86 is engaged with the recess 83*a* in shaft 83, and the knob 84 adjusted to the required height for the saw blade. The posts 60 are swung into the vertical position, and the upper table is lowered into the horizontal position of FIGS. 1, 3, 4, and 5. The saw is then used as a table saw, under the control of buttons 76.

Some known miter saws have a gearbox between the saw blade and the motor drive shaft and the saw blade is offset downwardly relative to the motor drive shaft by as much as 1.5 inches. While this may be acceptable for a miter saw which has no other function, it is preferable for embodiments of the present invention to have the saw blade 28 and motor drive shaft either coaxial, as in the above-described preferred embodiment, or offset (say by way of a gearbox) so that the axis of the saw blade 28 is offset upwards relative to the axis of the drive shaft of motor 30. Either of the latter two arrangements may allow the saw blade to protrude as much as 2.5 inches above the upper table 10, especially if a 12 inch diameter saw blade is used, and thus enable thicker lumber to be sawn.

Embodiments of the invention can also be considered, and sold, as a kit of parts for transforming a miter saw of the type described into a convertible miter/table saw. The kit of parts would include the upper table top assembly comprising the pivot brackets 50 held by base plates 53, the latter being suitable for fixing under the feet of the base frame 12 of the miter saw, and the rear legs 56 and upper table 10, with parts carried thereby. The kit would also include the brackets 62 for attachment to the front of the base frame, with the pivotally attached posts 60. Also, the kit would include the two-part blade guard 40, and the components of the blade height adjustment mechanism 80.

The contents of the various patents identified hereinbefore are incorporated herein by reference.

It will be appreciated by those skilled in the art that changes and modifications may be made thereto without departing from the invention in its broader aspects and as set forth in the following claims.

What is claimed is:

1. A conversion kit for converting a circular miter saw into a saw which is additionally useful as a table saw:

said circular miter saw comprising:

a base frame, a turntable with a saw slot mounted on the base frame for swivelling motion about a vertical axis, a pedestal carried by a rear part of said turntable and having a saw arm mounted thereon for movement about a horizontal pivot, a circular saw assembly including a saw blade and motor mounted on said saw arm, handle means for operating said saw arm, and a workpiece back guide fixedly mounted on said base frame, and having a first removable guard for said blade;

said conversion kit including:

a) an upper saw table and pivot means for connecting said upper table to a rear portion of said base frame for movement about a horizontal axis between a raised and a lowered generally horizontal position, said pivot means being such that the upper saw table, when in the raised position, is clear of the circular saw when said circular saw is being used in miter saw mode, said upper saw table having an upper saw slot which accommodates the circular saw blade when the latter is aligned therewith and when the upper saw table is in the lowered position, b) a support on the front of the upper saw table, said support being attachable to a front of said base frame when the upper saw table is in its lowered position, and c) a replacement guard for replacing said first removable saw blade guard, said replacement guard being a two part guard, a portion of which is readily removable to allow the saw blade to project through an opening formed by removing the portion of the two part guard and the slot in the upper saw table.

2. A conversion kit according to claim 1, wherein said means for supporting the front of the upper table comprise removable or displaceable posts.

3. A conversion kit according to claim 1, wherein said guard includes a lower portion which protects a lower front portion of the circular saw blade at all times, and a removable upper portion adapted to be removed when the upper saw table is to be lowered over the saw blade to allow the saw blade to project through the upper saw slot.

4. A conversion kit according to claim 1, wherein said pivot means includes brackets at each side of the rear portion of the base frame, which brackets are mounted on base plates extending forwardly from the brackets and attachable to the underside of said base frame.

* * * * *